US006137382A

United States Patent [19]

Toda et al.

[11] Patent Number: 6,137,382

[45] Date of Patent: Oct. 24, 2000

[54] DIELECTRIC DUPLEXER AND A COMMUNICATION DEVICE INCLUDING SUCH DIELECTRIC DUPLEXER

[75] Inventors: Jun Toda; Hideyuki Kato, both of Ishikawa-ken, Japan

[73] Assignee: Murata Manufacturing Co., Ltd., Japan

[21] Appl. No.: 09/253,809

[22] Filed: Feb. 19, 1999

[30] Foreign Application Priority Data

Feb. 20, 1998 [JP] Japan ..... 10-039433

[51] Int. Cl.[7] ..... H01P 1/20; H01P 7/04; H01P 5/12

[52] U.S. Cl. ..... 333/206; 333/222; 333/134

[58] Field of Search ..... 333/202, 206, 333/222, 134

[56] References Cited

U.S. PATENT DOCUMENTS 5,712,648 1/1998 Tsujiguchi ..... 333/134
5,831,495 11/1998 Hino ..... 333/202
5,905,420 5/1999 Tsujiguchi et al. ..... 333/206
6,020,800 2/2000 Arakawa et al. ..... 333/208

FOREIGN PATENT DOCUMENTS 2-90801 3/1990 Japan .

*Primary Examiner*—Robert Pascal
*Assistant Examiner*—Patricia T. Nguyen
*Attorney, Agent, or Firm*—Ostrolenk, Faber, Gerb & Soffen, LLP

[57] ABSTRACT

Antenna side through-holes pass through to the internal surfaces of neighboring resonator holes from an antenna side electrode. The antenna side through-holes (transverse holes) have their axes in a direction substantially at a right angle to the axial direction of the resonator holes and on the internal surface of the antenna side through-holes an inner conductor is formed. The transmission side filter and the antenna side electrode of a duplexer are electrically connected through an antenna side through-hole. The reception side filter and the antenna side electrode are also electrically connected through an antenna side through-hole.

14 Claims, 8 Drawing Sheets

DIELECTRIC DUPLEXER AND A COMMUNICATION DEVICE INCLUDING SUCH DIELECTRIC DUPLEXER

BACKGROUND OF THE INVENTION

1. Field of the Invention

The present invention relates to a dielectric duplexer and a communication device including such dielectric duplexer.

2. Description of the Related Art

A conventional dielectric duplexer to be used for mobile communication devices such as mobile phones, portable telephones, etc. is shown in FIGS. 10 and 11. The dielectric duplexer 21 has five resonator holes 2*a*, 2*b*, 2*c*, 2*d* and 2*e* formed, which pass through a pair of end surfaces 1*a*, 1*b* facing each other of a dielectric block 1 which is substantially rectangular, parallelepiped-shaped. Each of the resonator holes 2*a* through 2*e* has a large-in-diameter hole portion 15 circular in cross-section and a small-in-diameter hole portion 16 circular in cross-section linked to the large-in-diameter hole portion 15. (In FIG. 10, the construction of the resonator holes 2*a*, 2*d*, 2*e* in the dielectric block 1 is not illustrated.)

On nearly the whole external surface of the dielectric block 1, an outer conductor 4 is formed. A transmission side electrode Tx, a reception side electrode, and an antenna side electrode ANT are formed on the external surface of the dielectric block 1, spaced a fixed distance away from the outer conductor 4 in order to be non-conductive to the outer conductor 4.

On nearly the whole internal surface of each of the resonator holes 2*a* through 2*e* an inner conductor 3 is formed, with a gap 18 between the inner conductor 3 and a portion of the outer conductor 4 which extends into the opening portion of the large-in-diameter hole portion 15 a gap 18 is given. The end surface 1*a* on the side of the large-in-diameter hole portions 15 is referred to as an open-circuit end surface, and the end surface 1*b* on the side of the small-in-diameter hole portions 16 is referred to as a short-circuit end surface. The inner conductor 3 is electrically separated from the outer conductor 4 at the open-circuit end surface 1*a*, and is electrically short circuit connected to the outer conductor 4 at the short-circuit surface 1*b*. Further, the length in the axial direction of each of the resonator holes 2*a* through 2*e* is $\lambda/4$. (The Symbol $\lambda$ represents the central wavelength of the resonator formed by each of the resonator holes 2*a* through 2*e*.)

The above dielectric duplexer 21 is composed of a transmission side filter 10A made up of the two resonators formed from the resonator holes 2*a*, 2*b* and a reception side filter 10B made up of the three resonators formed from the resonator holes 2*c*, 2*d* and 2*e*. And between these filters 10A, 10B and the transmission side electrode Tx, reception side electrode Rx, and antenna side electrode ANT, an electromagnetic coupling is required. Because of this, on the left-hand side of the resonator hole 2*a* a transmission side excitation hole 5*a* and a transmission side external coupling adjustment hole 6*a* are formed. Between the resonator holes 2*b* and 2*c* an antenna side excitation hole 5*b* and an antenna side external coupling adjustment hole 6*b* are formed, and on the right-hand side of the resonator hole 2*e* a reception side excitation hole 5*c* and a reception side external coupling adjustment hole 6*c* are formed. (In FIG. 10, the construction of the excitation holes 5*a* through 5*c* and the external coupling adjustment holes 6*a* through 6*c* inside the dielectric block 1 is not illustrated.)

On the whole internal surface of the excitation holes 5*a* through 5*c* and the external coupling adjustment holes 6*a* through 6*c* an inner conductor 3 is formed respectively. The excitation holes 5*a*, 5*b* and 5*c* pass through the transmission side electrode Tx, antenna side electrode ANT, and reception side electrode Rx respectively. That is, the inner conductor 3 of each of the excitation holes 5*a* through 5*c* is electrically connected to the outer conductor 4 at the open-circuit end surface 1*a*, and is electrically separated from the outer conductor 4 at the short-circuit end surface 1*b*. On the other hand, the external coupling adjustment holes 6*a*, 6*b* and 6*c* are formed parallel with the excitation holes 5*a* through 5*c* in the vicinity of each of the excitation holes 5*a* to 5*c*, and the inner conductor 3 of each of the external coupling adjustment holes 6*a* to 6*c* is electrically connected to both the open-circuit end surface 1*a* and the short-circuit end surface 1*b*.

By changing the location, shape and inner dimension (size) of the external coupling adjustment holes 6*a* through 6*c*, the self-capacitance of the excitation holes 5*a* through 5*c* can be increased or decreased, and accordingly the degree of external coupling can be changed to establish a more appropriate external coupling. The self-capacitance of the excitation holes 5*a* through 5*c* means a capacitance generated between the inner conductor 3 of the excitation holes 5*a* through 5*c* and the ground conductor (including the outer conductor 4 and the inner conductor 3 of the external coupling adjustment holes 6*a* through 6*c*).

In this construction, the transmission side excitation hole 5*a* and the transmission side external coupling adjustment hole 6*a* are electromagnetically coupled with the resonator hole 2*a* neighboring those holes 5*a*, 6*a*. The antenna side excitation hole 5*b* and the antenna side external coupling adjustment hole 6*b* are electromagnetically coupled with the resonator holes 2*b*, 2*c* neighboring the holes 5*b*, 6*b*. The reception side excitation hole 5*c* and the reception side external coupling adjustment hole 6*c* are electromagnetically coupled with the resonator hole 2*e* neighboring the holes 5*c*, 6*c*. The external coupling is realized through these electromagnetic couplings. The dielectric duplexer 21 thus constructed outputs a transmission signal which enters the transmission side electrode Tx from a transmission circuit system not illustrated, and exits from the antenna side electrode after passing through the transmission side filter 10A. The dielectric duplexer 21 outputs a reception signal which enters from the antenna side electrode ANT, passes through the reception side filter 10B and exits to a reception circuit system not illustrated, from the reception side electrode Rx.

In this way, in the conventional dielectric duplexer 21, the excitation holes 5*a*, 5*b*, 5*c* were required in order to realize the electromagnetic coupling between the filters 10A, 10B and the transmission side electrode Tx, reception side electrode Rx, and antenna side electrode ANT. Further, because an especially high electromagnetic coupling is required between the antenna side electrode ANT and the filters 10A, 10B, it is difficult to shorten the spacing between the antenna side excitation hole 5*b* and the resonator holes 2*b*, 2*c* by adjusting the position of the antenna side external coupling adjustment hole 6*b*. In this dielectric duplexer, relatively long spacing is needed between the antenna side excitation hole 5*b* and the resonator holes 2*b*, 2*c*. Because of this, it is difficult to reduce the width of the conventional dielectric duplexer 21.

SUMMARY OF THE INVENTION

In view of the foregoing problems, the present invention is able to provide a small-sized dielectric duplexer which does not necessarily require excitation holes and external coupling adjustment holes and a communication device containing such dielectric duplexer.

One preferred embodiment of the present invention provides a dielectric duplexer, comprising: a dielectric block including a pair of end surfaces facing each other; a plurality of resonator holes passing through the pair of end surfaces of said dielectric block and including a first inner conductor provided on each internal surface thereof respectively; an outer conductor provided on the external surface of the dielectric block, an antenna side electrode, a reception side electrode, and a transmission side electrode provided on the external surface of the dielectric block respectively, and an antenna side through hole passing through to the internal surface of one of said plurality of resonator holes from the antenna electrode and including a second inner conductor on the internal surface thereof.

According to the above described structure and arrangement, the degree of electromagnetic coupling between the filter made up of the resonator holes and the antenna side electrode is adjusted by changing the location at which the antenna side through-hole is connected to the antenna side electrode, resonator holes, and antenna side excitation holes, or the shape and inner dimension(size) of the antenna side through-hole.

The above described dielectric duplexer may further comprise a reception side through-hole passing through to the internal surface of one of said plurality of resonator holes from the reception side electrode and including a third inner conductor on the internal surface thereof, and a transmission side through hole passing through to the internal surface of one of said plurality of resonator holes from the transmission side electrode and including a fourth inner conductor on the internal surface thereof.

A preferred embodiment of the present invention further provides a dielectric duplexer, comprising: a dielectric block including a pair of end surfaces facing each other; a plurality of resonator holes passing through the pair of end surfaces of said dielectric block and having a first inner conductor provided on an internal surface thereof respectively; an outer conductor provided on the external surface of the dielectric block; an antenna side electrode, a reception side electrode, and a transmission side electrode provided on the external surface of the dielectric block respectively; an antenna side excitation hole substantially in parallel with said resonator holes, passing through the antenna side electrode, and including a fifth inner conductor on the internal surface thereof; and an antenna side through-hole passing through to the internal surface of one of said plurality of resonator holes from the internal surface of said antenna side excitation hole and including a second inner conductor on the internal surface thereof.

The above described dielectric duplexer may further comprise a reception side excitation hole provided substantially in parallel with said resonator holes, passing through the reception side electrode and including a sixth inner conductor on the internal surface thereof, a reception side through-hole passing through to the internal surface of one of said plurality of resonator holes from the internal surface of the reception side excitation hole and including a third inner conductor on the internal surface thereof, a transmission side excitation hole provided substantially in parallel with said resonator holes, passing through said transmission side electrode and including a seventh inner conductor on the internal surface thereof, and a transmission side through-hole passing through to the internal surface of one of said plurality of the resonator holes from the internal surface of the transmission side excitation hole and having a fourth inner conductor on the internal surface thereof.

According to the above described structure and arrangement, the degree of electromagnetic coupling between the filter made up of resonator holes and the transmission side and reception side electrodes is adjusted by changing the locations at which the transmission side and reception side through-holes are connected to the transmission side and reception side electrodes, resonator holes, and transmission side and reception side excitation holes, or by changing the shapes and inner dimensions (size) of the transmission side and reception side through-holes.

Further, by providing a concave portion or recess in the antenna side electrode and locating the antenna side through-hole so as to pass through the surface of this concave portion, the length of the antenna side through-hole is able to be freely adjusted to establish the degree of electromagnetic coupling between the filter and the antenna side electrode.

Furthermore, a preferred embodiment of the present invention provides a communication device including the above described dielectric duplexer.

According to the above described arrangement, it is possible to make a communication device of small size by using a dielectric duplexer having a small width.

Other features and advantages of the present invention will become apparent from the following description of embodiments of the invention which refers to the accompanying drawings, in which like references denote like elements and parts.

DESCRIPTION OF PREFERRED EMBODIMENTS OF THE INVENTION

Figure 1:
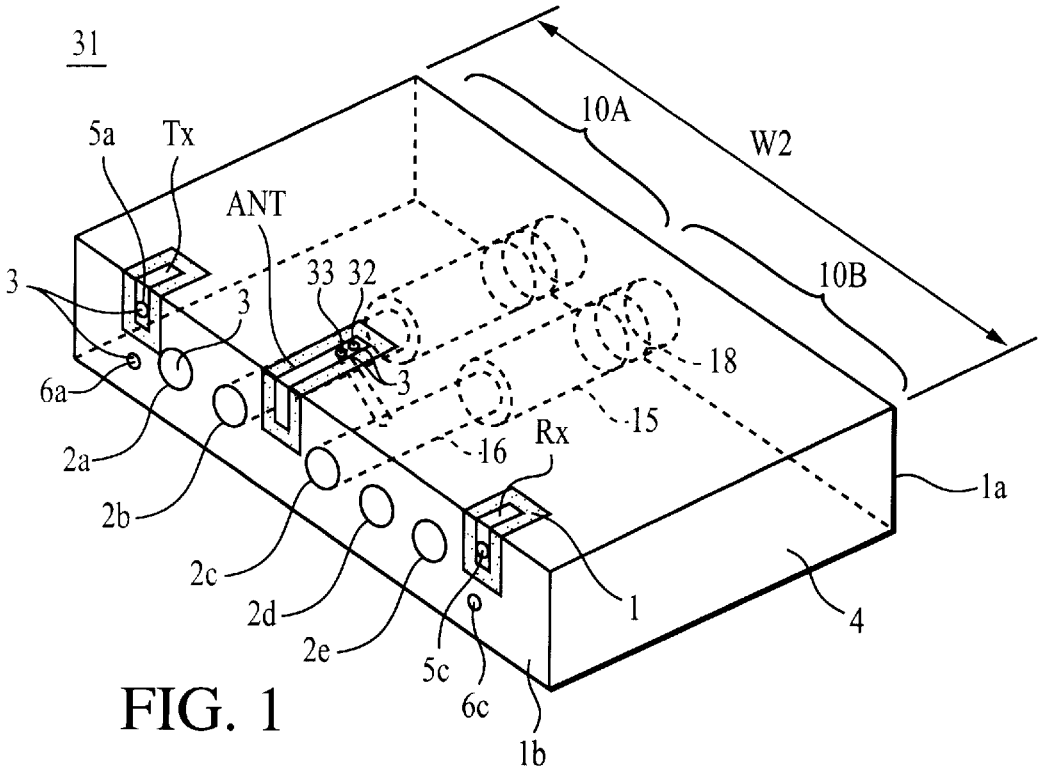
FIG. 1 is a perspective view showing a first preferred embodiment of a dielectric duplexer according to the present invention.
Figure 2:
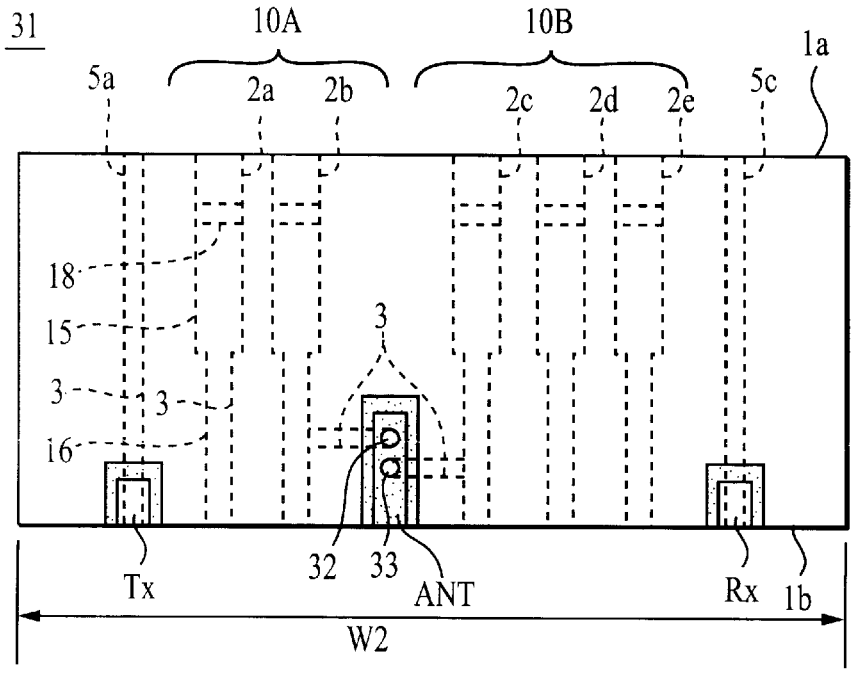
FIG. 2 is a top plan view of the dielectric duplexer shown in FIG. 1.

A first preferred embodiment of a dielectric duplexer according to the present invention is shown in FIGS. 1 and 2. This dielectric duplexer 31 is in some ways similar to the conventional dielectric duplexer 21 explained in FIGS. 10 and 11, but has in addition antenna side through-holes 32, 33 passing through to the internal surfaces of resonator holes 2*b*, 2*c* from the antenna side electrode ANT, instead of the antenna side excitation hole 5*b* and the antenna side external coupling adjustment hole 6*b* of the conventional dielectric duplexer 21.

Figure 10:
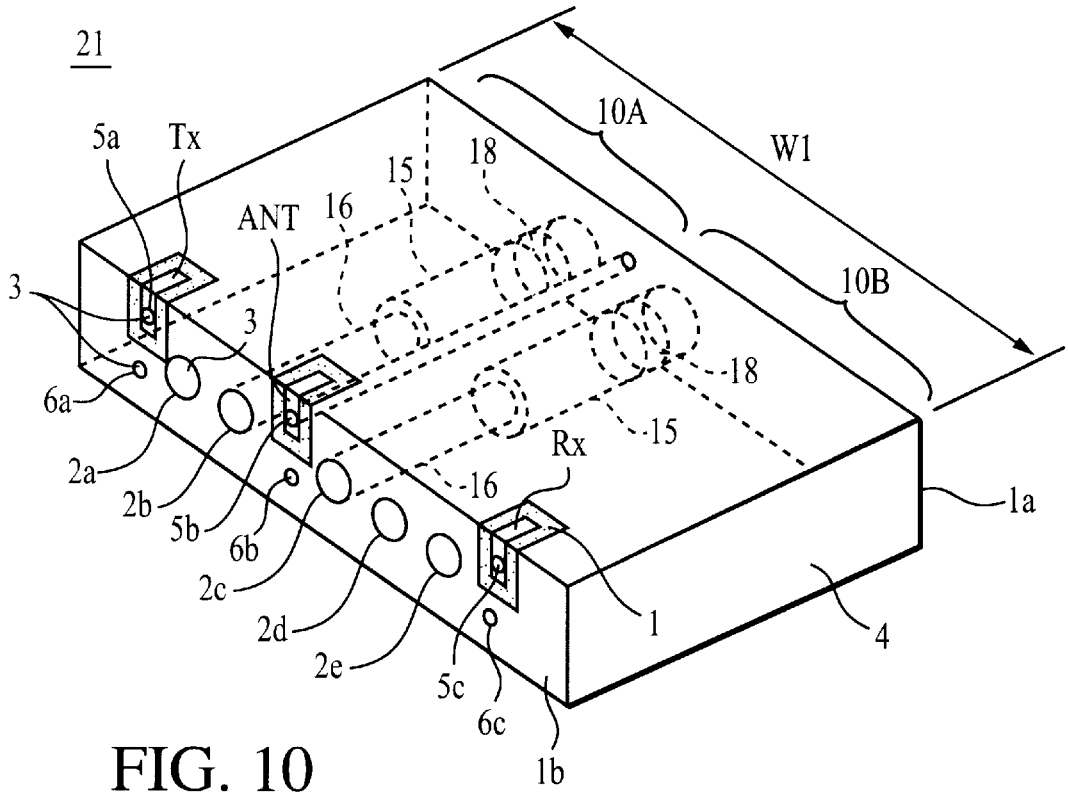
FIG. 10 PRIOR ART
FIG. 10 is a perspective view showing a conventional dielectric duplexer.
Figure 11:
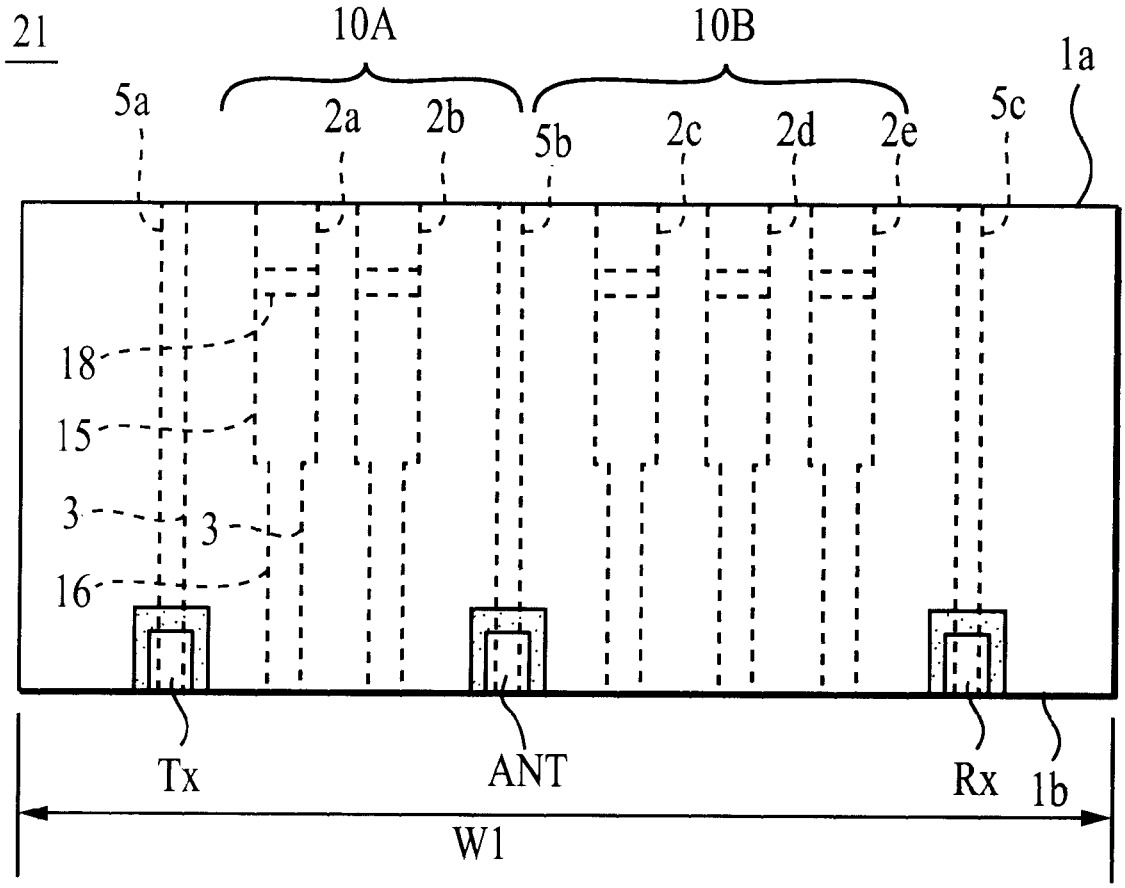
FIG. 11 PRIOR ART
FIG. 11 is a top plan view of the conventional dielectric duplexer shown in FIG. 10.

That is, in the dielectric duplexer 31, the antenna side through-holes (transverse holes) 32, 33 are formed in the dielectric block 1 with their axes in a direction substantially at a right angle to the axial direction of the resonator holes 2*b*, 2*c* and connecting the antenna side electrode ANT to the neighboring resonator holes 2*b*, 2*c*. An inner conductor 3 is provided on the internal surface of the antenna side through-holes 32, 33. In short, one end portion of the antenna side through-hole 32 is electrically connected to the antenna side electrode ANT, and the other end portion is electrically connected to the inner conductor 3 of the resonator hole 2*b*. One end portion of the inner conductor 3 of the antenna side through-hole 33 is electrically connected to the antenna side electrode ANT, and the other end portion is electrically connected to the inner conductor 3 of the resonator hole 2*c*. In FIGS. 1 and 2, the portions corresponding to those in FIGS. 10 and 11 are given the corresponding reference numerals, and their overlapping explanation is omitted.

In the dielectric duplexer 31 thus constructed, the transmission side filter 10A and the antenna side electrode ANT are electrically connected through the antenna side through-hole 32. In like manner, the reception side filter 10B and the antenna side electrode ANT are electrically connected through the antenna side through-hole 33. The degree of electromagnetic coupling between the antenna side electrode ANT and the transmission side filter 10A, and the degree of electromagnetic coupling between the antenna side electrode ANT and the reception side filter 10B, can be adjusted by changing the locations at which the antenna side through-holes 32, 33 are connected to the antenna side electrode ANT and the resonator holes 2*b*, 2*c* respectively, or by changing the shapes and inner dimensions (size) of the antenna side through-holes 32, 33.

Accordingly, without forming any antenna side excitation hole 5*b* and antenna side external coupling adjustment hole 6*b*, it is possible to obtain a dielectric duplexer 31 having a high electromagnetic coupling between the antenna side electrode ANT and the filters 10A, 10B. As a result, by making the spacing between the resonator holes 2*b* and 2*c* small, the width W2 of the duplexer 31 can be made narrower than the width W1 of the conventional duplexer 21, to make a duplexer which is smaller in size.

Figure 3:
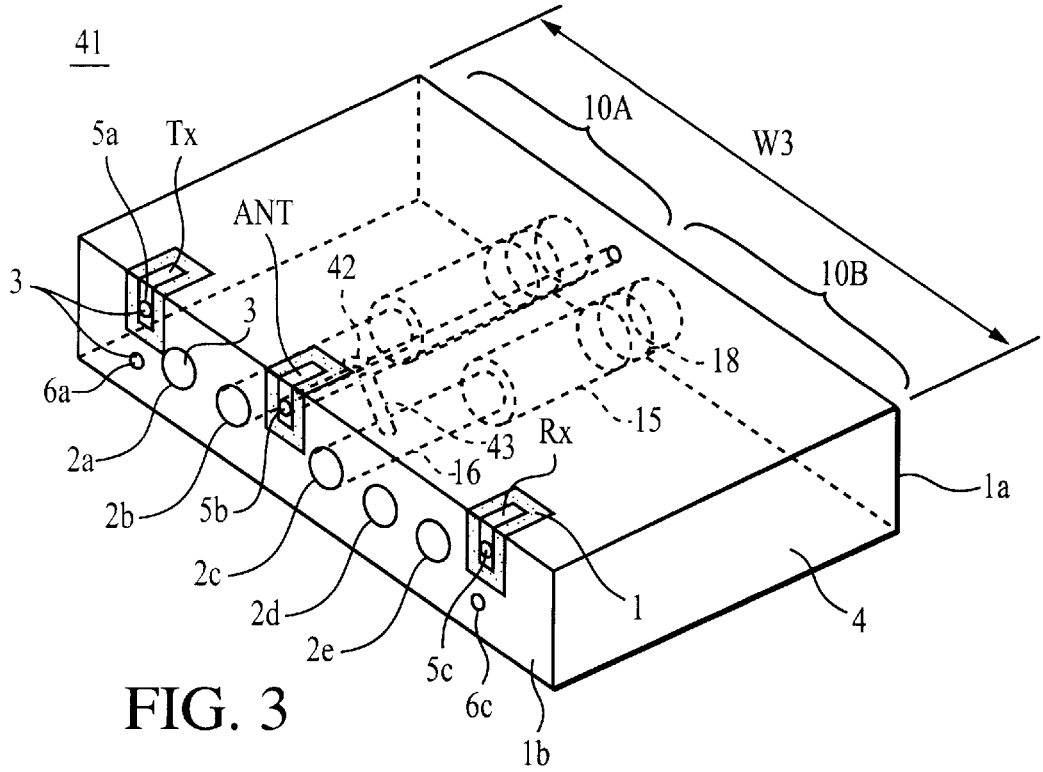
FIG. 3 is a perspective view showing a second preferred embodiment of a dielectric duplexer according to the present invention.
Figure 4:
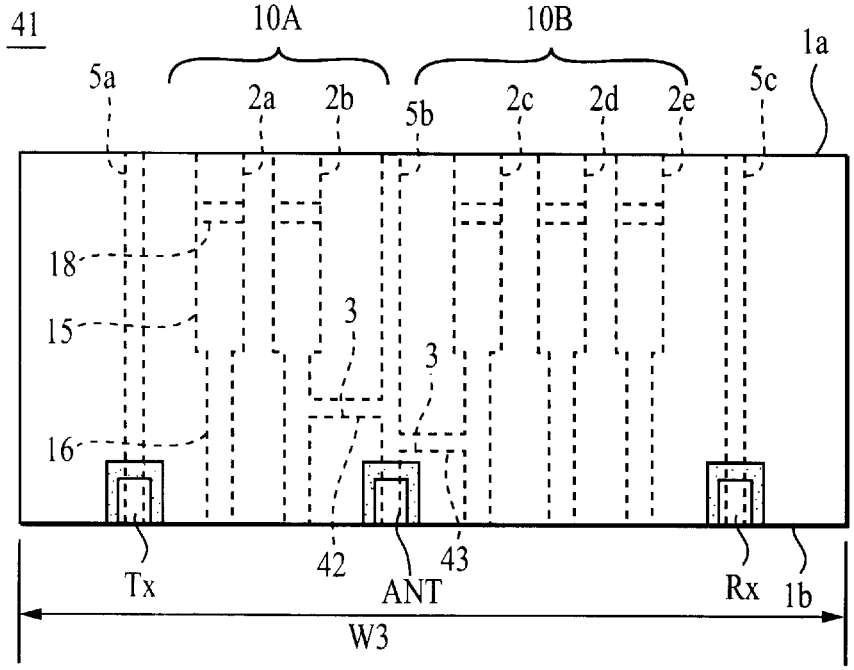
FIG. 4 is a top view of the dielectric duplexer shown in FIG. 3.

A second preferred embodiment of a dielectric duplexer according to the present invention is shown in FIGS. 3 and 4. The dielectric duplexer 41 is similar in some ways to the dielectric duplexer 21, but has antenna side through-holes 42, 43 passing through to the internal surfaces of the resonator holes 2*b*, 2*c* from the internal surface of the antenna side excitation hole 5*b*. The antenna side external coupling adjustment hole 6*b* of the conventional dielectric duplexer is omitted.

That is, the antenna side through-holes (transverse holes) 42,43 are formed with their axes in a direction substantially at a right angle to the axial direction of the resonator holes 2*b*, 2*c* and are formed respectively between the resonator hole 2*b* and the antenna side excitation hole 5*b* and between the resonator hole 2*c* and the antenna side excitation hole 5*b*. The inner conductor 3 is formed on the internal surfaces of the antenna side through-holes 42, 43. In short, one end portion of the inner conductor 3 on the antenna side through-hole 42 is electrically connected to the inner conductor 3 of the antenna side excitation hole 5*b*, and the other end portion is electrically connected to the inner conductor 3 of the resonator hole 2*b*. One end portion of the inner conductor 3 of the antenna side through-hole 43 is electrically connected to the inner conductor 3 of the antenna side excitation hole 5*b*, and the other end portion is electrically connected to the inner conductor 3 of the resonator hole 2*c*. In FIGS. 3 and 4, the portions corresponding to those in FIGS. 10 and 11 are given the corresponding reference numerals, and their overlapping explanation is omitted.

In the dielectric duplexer 41 thus constructed, the transmission side filter 10A and the antenna side electrode ANT are electrically connected through the antenna side excitation hole 5*b* and the antenna side through-hole 42. Similarly, the reception side filter 10B and the antenna side electrode ANT are electrically connected through the antenna side excitation hole 5*b* and the antenna side through-hole 43. The degree of electromagnetic coupling between the antenna side electrode ANT and the transmission side filter 10A and the degree of electromagnetic coupling between the antenna side electrode ANT and the reception side filter 10B are able to be adjusted by changing the locations at which the antenna side through-holes 42, 43 are connected to the antenna side excitation hole 5*b* and the resonator holes 2*b*, 2*c* respectively, or by changing the shapes and inner dimensions (size) of the antenna side through-holes 42, 43.

Therefore, without forming any antenna side external coupling adjustment hole 6*b* in the dielectric block 1, it is possible to obtain a dielectric duplexer 41 having a high electromagnetic coupling between the antenna side electrode ANT and the filters 10A, 10B. As a result, by making the spacing between the resonator holes 2*b* and 2*c* small, the width W3 of the duplexer 41 is able to be made narrower than the width W1 of the conventional duplexer 21, and the duplexer is made smaller in size.

Figure 5A:
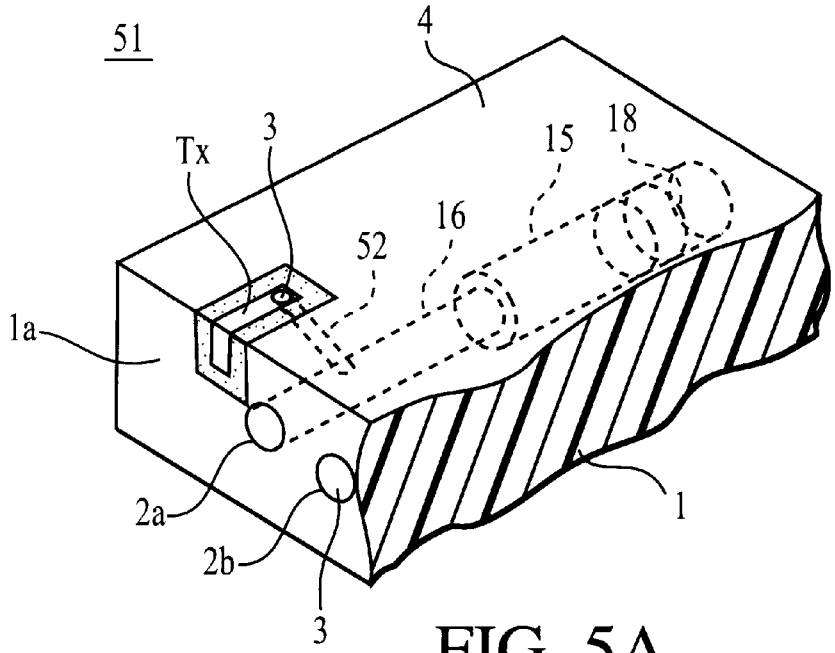
FIGS. 5A and 5B are partially cutaway perspective views showing a third preferred embodiment of a dielectric duplexer according to the present invention.
Figure 5B:
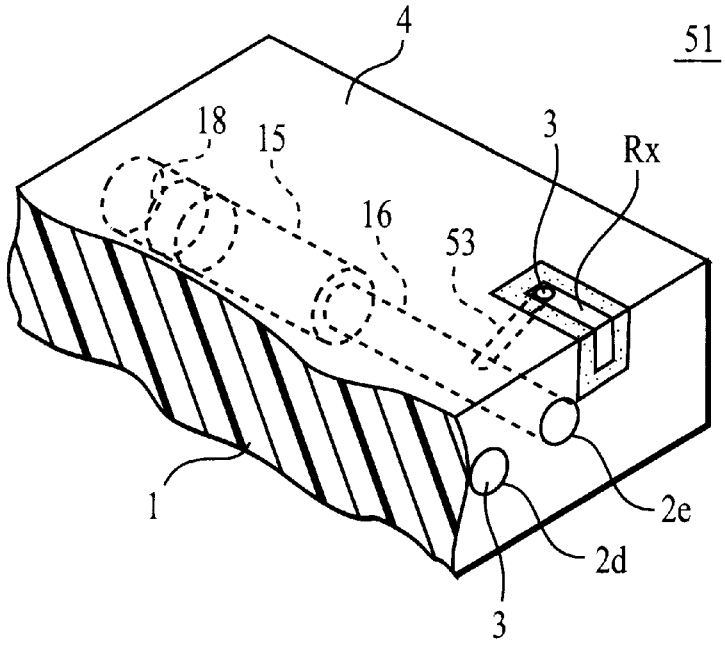

As shown in FIGS. 5A and 5B, a dielectric duplexer 51 according to a third preferred embodiment is a modification to the dielectric duplexer 31 according to the first preferred embodiment described above, having a transmission side through-hole 52 passing through to the internal surface of the resonator hole 2*a* from the transmission side electrode Tx. The transmission side excitation hole 5*a* and transmission side external coupling adjustment hole 6*a* are omitted. Also, a reception side through-hole 53 passes through to the internal surface of the resonator hole 2*e* from the reception side electrode Rx. The reception side excitation hole 5*c* and the reception side external coupling adjustment hole 6*c* omitted.

That is, in the dielectric duplexer 51, the transmission side through-hole (transverse hole) 52 and the reception side through-hole (transverse hole) having their axes in the direction substantially at a right angle to the axial direction of the resonator holes 2*a*, 2*e* are formed on the left-hand side of the resonator hole 2*a* and on the right-hand side of the resonator hole 2*e* in the dielectric block 1 respectively, and the inner conductors 3 are formed on the internal surfaces of the reception side through-hole and the transmission side through-hole 52 respectively. In short, one end portion of the inner conductor 3 of the transmission side through-hole 52 is electrically connected to the transmission side electrode Tx, and the other end portion is electrically connected to the inner conductor 3 of the resonator hole 2*a*. One end portion of the inner conductor of the reception side through-hole is electrically connected to the reception side electrode, and the other end portion is electrically connected to the inner conductor 3 of the resonator hole 2*e*.

In the dielectric duplexer 51 thus constructed, the transmission side filter 10A is electrically connected to the antenna side electrode ANT and the transmission side electrode Tx through the antenna side through-hole 32 and the transmission side through-hole 52. Similarly, the reception side filter 10B is electrically connected to the antenna side electrode ANT and the reception side electrode Rx through the antenna side through-hole 33 and the reception side through-hole 53. The degree of electromagnetic coupling between the antenna side electrode ANT, the transmission side electrode Tx and the transmission side filter 10A is able to be adjusted by changing the location at which the antenna side through-hole 32 is connected to the antenna side electrode ANT and the resonator hole 2*b*, or by changing the location at which the transmission side through-hole 52 is connected to the transmission side electrode Tx and the resonator hole 2*a*. In like manner, the degree of electromagnetic coupling between the antenna side electrode ANT, the reception side electrode Rx and the reception side filter 10B is able to be adjusted by changing the location at which the antenna side through-hole 33 is connected to the antenna side electrode ANT and the resonator 2*c*, or by changing the location at which the reception side through-hole 53 is connected to the reception side electrode Rx and the resonator hole 2*e*.

Therefore, it is possible to obtain a dielectric duplexer having a high electromagnetic coupling between the antenna side electrode ANT, the transmission side electrode Tx, and the reception side electrode Rx and the filters 10A, 10B without forming any of the excitation holes 5*a* through 5*c* and external coupling adjustment holes 6*a* through 6*c* in the dielectric block 1.

Figure 6A:
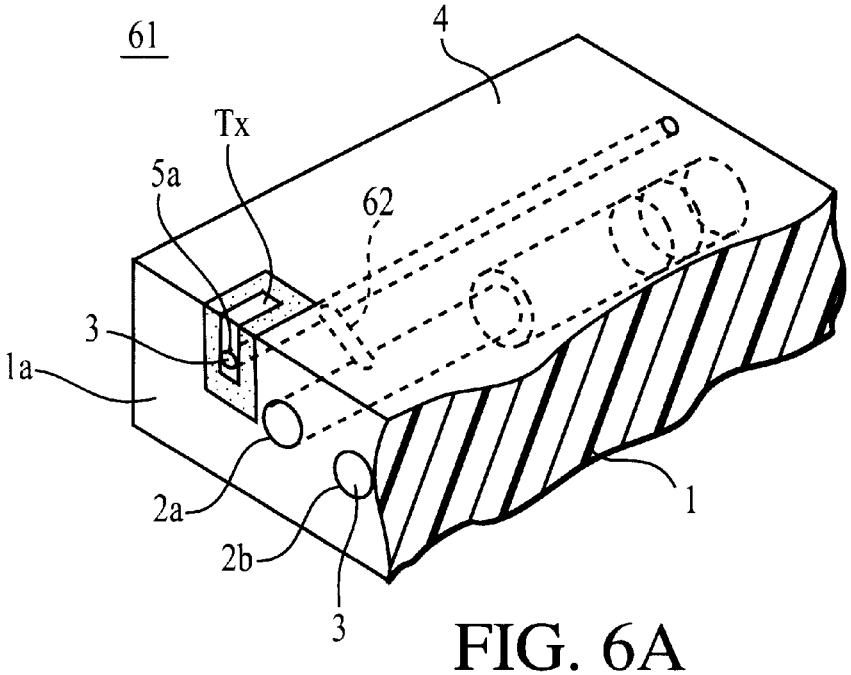
FIGS. 6A and 6B are partially cutaway perspective views showing a fourth preferred embodiment of a dielectric duplexer according to the present invention.
Figure 6B:
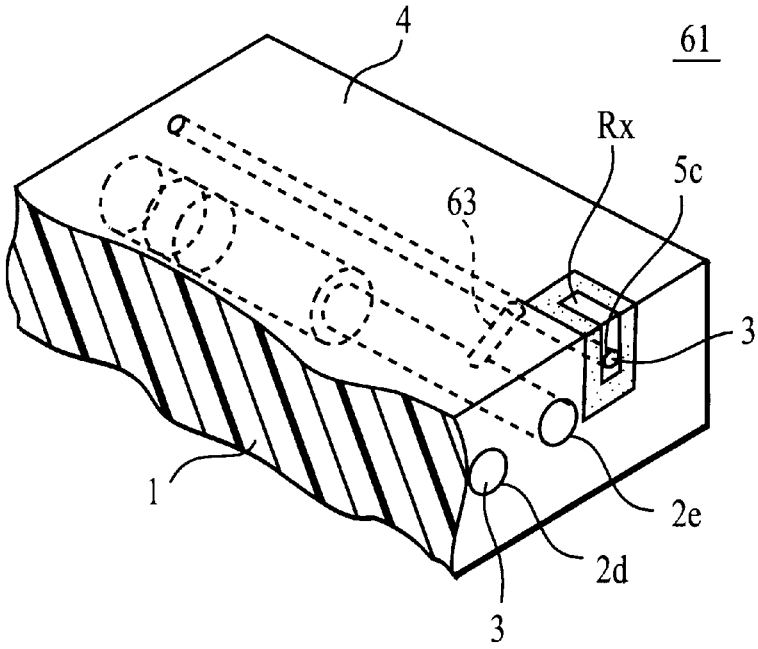

As shown in FIGS. 6A and 6B, a dielectric duplexer 61 according to a fourth preferred embodiment is a modification of the dielectric duplexer 41 of the second preferred embodiment described above, having a transmission side through-hole 62 passing through to the internal surface of the resonator 2*a* from the internal surface of the transmission side excitation hole 5*a*, but not having the transmission side external coupling adjustment hole 6*a*, and having a reception side through-hole 63 passing through to the internal surface of the resonator hole 2*e* from the internal surface of the reception side excitation hole 5*c*, but not having the reception side external coupling adjustment hole 6*c*.

That is, in the dielectric duplexer 41, the transmission side through-hole (transverse hole) 62 and the reception side through-hole (transverse hole) having their axes in a direction substantially at a right angle to the axial direction of the resonator holes 2*a*, 2*e* are formed between the resonator hole 2*a* and the transmission side excitation hole 5*a* and between the resonator hole 2e and the reception side excitation hole 5*c* respectively, and inner conductors 3 are formed on the internal surfaces of the transmission side through-hole and reception side through hole. In short, one end portion of the inner conductor 3 of the transmission side through-hole 62 is electrically connected to an inner conductor 3 of the transmission side excitation hole 5*a*, and the other end portion is electrically connected to the inner conductor 3 of the resonator hole 2*a*. One end portion of the inner conductor of the reception side through-hole is electrically connected to an inner conductor of the reception side excitation hole 5*c*, and the other end portion is electrically connected to the inner conductor 3 of the resonator hole 2*e*.

In the dielectric duplexer 61 thus constructed, the transmission side filter 10A is electrically connected to the antenna side electrode ANT through the antenna side excitation hole 5*b* and the antenna side through-hole 42, and is electrically connected to the transmission side electrode Tx through the transmission side excitation hole 5*a* and the transmission side through-hole 62. In like manner, the reception side filter 10B is electrically connected to the antenna side electrode ANT through the antenna side excitation hole 5*b* and the antenna side through-hole 43, and is electrically connected to the reception side electrode Rx through the reception side excitation hole 5*c* and the reception side through-hole 63. The degree of electromagnetic coupling between the antenna side electrode ANT, the transmission side electrode Tx and the transmission side filter 10A is able to be adjusted by changing the respective locations at which the antenna side through-hole 32 is connected to the antenna side excitation hole 5*b* and the resonator hole 2*b*, or by changing the respective locations at which the transmission side through-hole 62 is connected to the transmission side excitation hole 5*a* and the resonator hole 2*a*. Similarly, the degree of electromagnetic coupling between the antenna side electrode ANT, the reception side electrode Rx and the reception side filter 10B is able to be adjusted by changing the respective locations at which the antenna side through-hole 33 is connected to the antenna side excitation hole 5*b* and the resonator hole 2*c*, or by changing the respective locations at which the reception side through-hole 63 is connected to the reception side excitation hole 5*c* and the resonator hole 2*e*.

Accordingly, it is possible to obtain a dielectric duplexer 61 having a high electromagnetic coupling between the antenna side electrode ANT, transmission side electrode Tx, and reception side electrode Rx and the filters 10A, 10B without forming any external coupling adjustment holes 6*a* through 6*c* in the dielectric block 1. As the result, the width of duplexer 61 is able to be made narrower than the width of the duplexer 41 according to the second embodiment described above.

Figure 7:
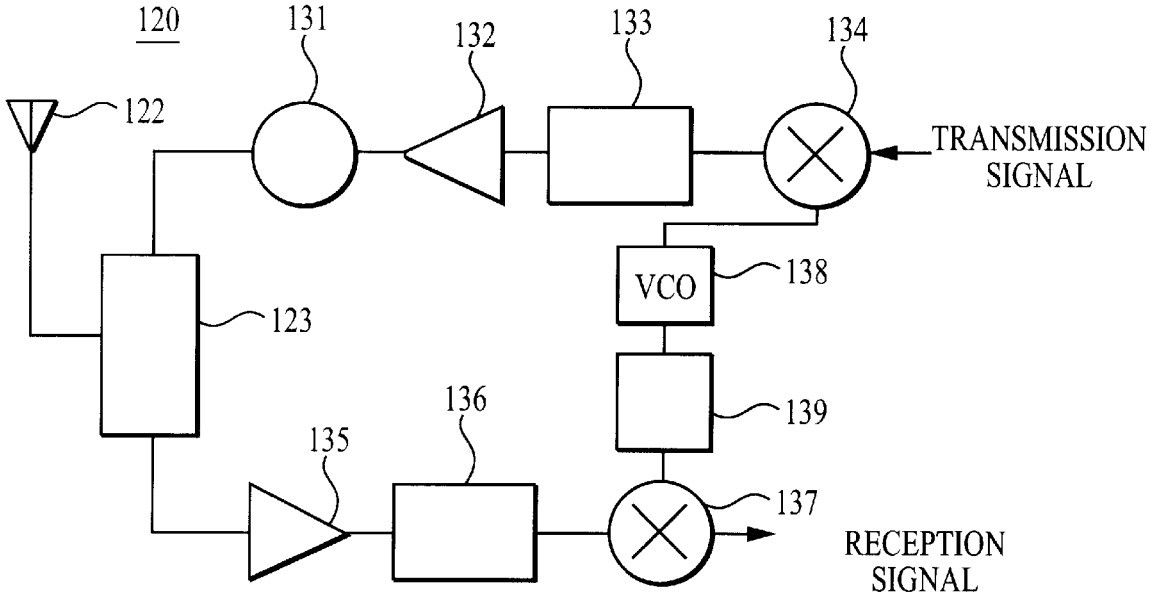
FIG. 7 is a block diagram of electric circuit showing a fifth preferred embodiment of a communication device according to the present invention.

According to a fifth preferred embodiment of a communication device according to the present invention, a portable telephone is explained as an example. FIG. 7 is a block diagram showing the electrical circuits of the RF portion of a portable telephone 120. In FIG. 7, reference numeral 122 represents an antenna element, 123 a dielectric duplexer, 131 a transmission side isolator, 132 a transmission side amplifier, 133 a transmission side interstage band pass filter, 134 a transmission side mixer, 135 a reception side amplifier, 136 a reception side interstage band pass filter, 137 a reception side mixer, 138 a voltage-controlled oscillator (VCO), and 139 a band pass filter for local use.

Here, as a dielectric duplexer 123, for example, the duplexers 31, 41, 51, 61 according to the first through fourth preferred embodiment described above can be used. In this way, the portable telephone 120 is able to be made small-sized by making use of a dielectric duplexer 31 (or either of 41, 51, and 61) having a small width.

A dielectric duplexer and a communication device containing such dielectric duplexer according to the present invention are not restricted to the embodiments described above, and various modifications are available within the true spirit and scope of the invention.

Figure 8A:
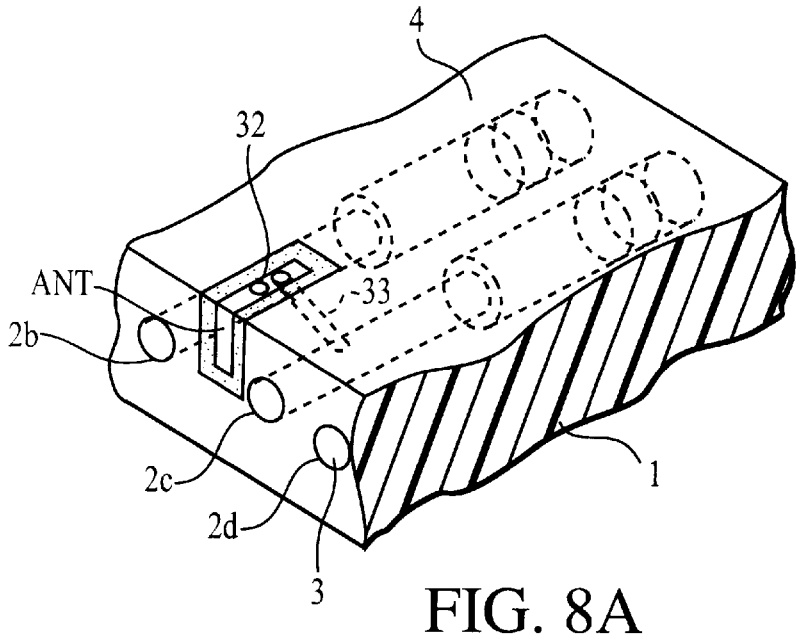
FIG. 8A is a partially cutaway perspective view showing another preferred embodiment.
Figure 8B:
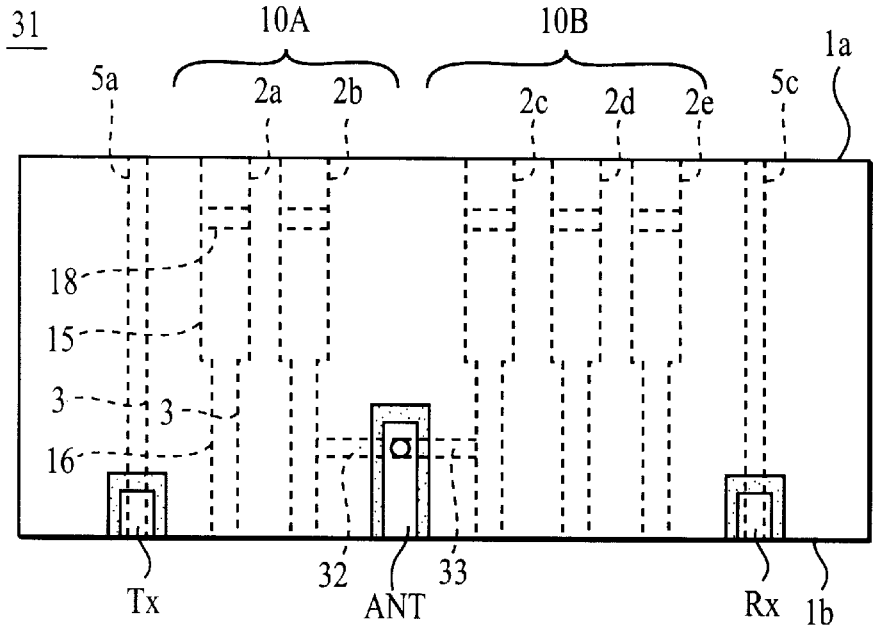
FIG. 8B is a top plan view of the dielectric duplexer shown in FIG. 8A.

For example, in the dielectric duplexer 31 of the first preferred embodiment, the antenna side through-holes 32, 33 may have a common opening at the antenna side electrode ANT as shown in FIGS. 8A and 8B.

Figure 9:
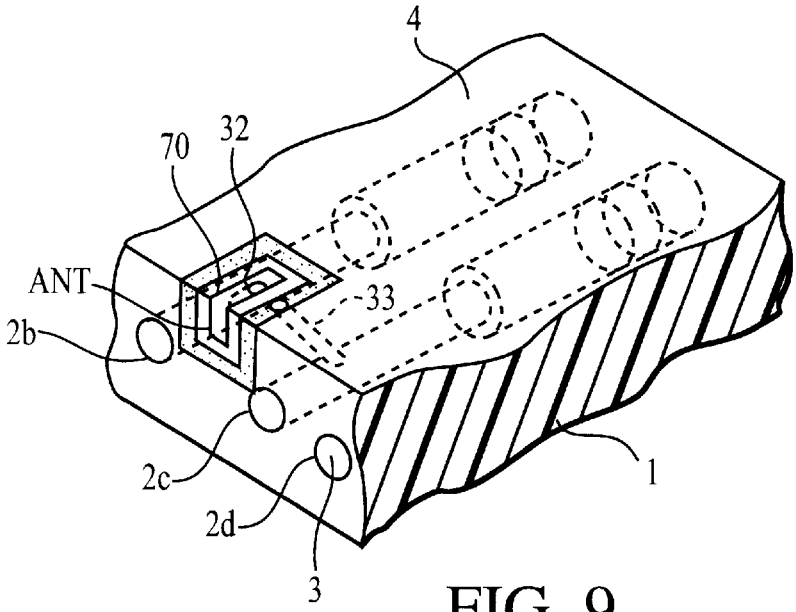
FIG. 9 is a partially cutaway perspective view showing yet another preferred embodiment.

And as shown in FIG. 9, a concave portion or recess 70 may be formed in the dielectric block 1 at the antenna side electrode ANT, so that the antenna side through-holes 32, 33 can pass through the surface of the concave portion 70. Because of this, by changing the depth of the recess 70, the length of the antenna side through-holes 32, 33 is able to be adjusted to freely establish the degree of electromagnetic coupling between the filters 10A, 10B and the antenna side electrode ANT.

Further, although the third and fourth embodiments are described as being modifications of the first and second embodiments, they could instead modify the second and first embodiments, respectively. Moreover, it would be permissible in an appropriate case to modify only one or two of the transmitting side, receiving side and antenna side electrodes according to one or more of the embodiments, without modifying the remaining electrode(s). The various embodiments can be combined in any way desired.

As clearly explained above, according to the present invention, by providing an antenna side through-hole passing through to the internal surface of a resonator hole from the antenna side electrode, or by providing an antenna side through-hole passing through to the internal surface of a resonator hole from the internal surface of an antenna side excitation hole, or the other through-holes disclosed herein, it is possible to obtain an dielectric duplexer having a high electromagnetic coupling between the filter made up of the resonator hole and the antenna side electrode without the antenna side excitation hole, antenna side external coupling adjustment hole, and types of hole required up to now.

As a result, the width of the dielectric duplexer can be made narrower than the width of the conventional duplexer, so the duplexer can be small-sized. Further, the use of a duplexer having a less width makes the communication device small-sized.

While the invention has been particularly shown and described with reference to preferred embodiments thereof, it will be understood by those skilled in the art that the foregoing and other changes in form and details may be made therein without departing from the spirit of the invention.

What is claimed is:

1. A communication device, comprising:

a dielectric block including a pair of opposite end surfaces;

a plurality of resonator holes passing through the pair of end surfaces of said dielectric block and each including a respective first inner conductor provided on an internal surface thereof;

an outer conductor provided on the external surface of the dielectric block, an antenna side electrode, a reception side electrode, and a transmission side electrode provided on the external surface of the dielectric block, and an antenna side through hole passing through to the internal surface of one of said plurality of resonator holes from the antenna side electrode and including a second inner conductor on the internal surface thereof.

2. The communication device according to claim 1, further comprising:

a reception side through-hole passing through to the internal surface of one of said plurality of resonator holes from the reception side electrode and including a third inner conductor on the internal surface thereof, and a transmission side through hole passing through to the internal surface of one of said plurality of resonator holes from the transmission side electrode and including a fourth inner conductor on the internal surface thereof.

3. A communication device, comprising:

a dielectric block including a pair of opposite end surfaces;

a plurality of resonator holes passing through the pair of end surfaces of said dielectric block and having a respective first inner conductor provided on an internal surface thereof;

an outer conductor provided on the external surface of the dielectric block;

an antenna side electrode, a reception side electrode, and a transmission side electrode provided on the external surface of the dielectric block;

an antenna side excitation hole substantially in parallel with said resonator holes, passing through the antenna side electrode, and including a fifth inner conductor on the internal surface thereof; and an antenna side through-hole passing through to the internal surface of one of said plurality of resonator holes from the internal surface of said antenna side excitation hole and including a second inner conductor on the internal surface thereof.

4. The communication device according to claim 3, further comprising:

a reception side excitation hole provided substantially in parallel with said resonator holes, passing through the reception side electrode and including a sixth inner conductor on the internal surface thereof, a reception side through-hole passing through to the internal surface of one of said plurality of resonator holes from the internal surface of the reception side excitation hole and including a third inner conductor on the internal surface thereof, a transmission side excitation hole provided substantially in parallel with said resonator holes, passing through said transmission side electrode and including a seventh inner conductor on the internal surface thereof, and a transmission side through-hole passing through to the internal surface of one of said plurality of the resonator holes from the internal surface of the transmission side excitation hole and having a fourth inner conductor on the internal surface thereof.

5. The communication device according to claim 1, wherein a recess is provided in the antenna side electrode and the antenna side through-hole passes through the recess.

6. The communication device according to claim 2, wherein a recess is provided in the antenna side electrode and the antenna side through-hole passes through the recess.

7. The communication device of claim 1, further comprising an antenna circuit connected to said antenna side electrode, a receiving circuit connected to said reception side electrode, and a transmitting circuit connected to said transmission side electrode.

8. The communication device of claim 2, further comprising an antenna circuit connected to said antenna side electrode, a receiving circuit connected to said reception side electrode, and a transmitting circuit connected to said transmission side electrode.

9. The communication device of claim 3, further comprising an antenna circuit connected to said antenna side electrode, a receiving circuit connected to said reception side electrode, and a transmitting circuit connected to said transmission side electrode.

10. The communication device of claim 4, further comprising an antenna circuit connected to said antenna side electrode, a receiving circuit connected to said reception side electrode, and a transmitting circuit connected to said transmission side electrode.

11. The communication device of claim 5, further comprising an antenna circuit connected to said antenna side electrode, a receiving circuit connected to said reception side electrode, and a transmitting circuit connected to said transmission side electrode.

12. The communication device of claim 6, further comprising an antenna circuit connected to said antenna side electrode, a receiving circuit connected to said reception side electrode, and a transmitting circuit connected to said transmission side electrode.

13. A communication device, comprising:

a dielectric block including a pair of opposite end surfaces;

a plurality of resonator holes passing through the pair of end surfaces of said dielectric block and each including a respective inner conductor provided on an internal surface thereof;

an outer conductor provided on the external surface of the dielectric block;

an antenna side electrode, a reception side electrode, and a transmission side electrode provided on the external surface of the dielectric block;

a reception side through-hole passing through to the internal surface of one of said plurality of resonator holes from the reception side electrode and including an inner conductor on the internal surface thereof; and a transmission side through hole passing through to the internal surface of one of said plurality of resonator holes from the transmission side electrode and including an inner conductor on the internal surface thereof.

14. A communication device, comprising:

a dielectric block including a pair of opposite end surfaces;

a plurality of resonator holes passing through the pair of end surfaces of said dielectric block and each including a respective inner conductor provided on an internal surface thereof;

an outer conductor provided on the external surface of the dielectric block;

an antenna side electrode, a reception side electrode, and a transmission side electrode provided on the external surface of the dielectric block;

a reception side excitation hole provided substantially in parallel with said resonator holes, passing through the reception side electrode and including an inner conductor on the internal surface thereof;

a reception side through-hole passing through to the internal surface of one of said plurality of resonator holes from the internal surface of the reception side excitation hole and including an inner conductor on the internal surface thereof;

a transmission side excitation hole provided substantially in parallel with said resonator holes, passing through said transmission side electrode and including an inner conductor on the internal surface thereof; and a transmission side through-hole passing through to the internal surface of one of said plurality of resonator holes from the internal surface of the transmission side excitation hole and having an inner conductor on the internal surface thereof.

* * * * *